US007566042B1

(12) United States Patent
Yates

(10) Patent No.: US 7,566,042 B1
(45) Date of Patent: Jul. 28, 2009

(54) PICTURE HANGING APPARATUS

(76) Inventor: William Shuford Yates, 1416 Woodmont Dr., Greeneville, TN (US) 37743

( * ) Notice: Subject to any disclaimer, the term of this patent is extended or adjusted under 35 U.S.C. 154(b) by 34 days.

(21) Appl. No.: 11/959,031

(22) Filed: Dec. 18, 2007

Related U.S. Application Data

(60) Provisional application No. 60/870,446, filed on Dec. 18, 2006.

(51) Int. Cl.
*A47F 1/14* (2006.01)

(52) U.S. Cl. ..... 248/466

(58) Field of Classification Search ..... 248/544, 248/682, 466, 489
See application file for complete search history.

(56) References Cited

U.S. PATENT DOCUMENTS

| | | | | |
|---|---|---|---|---|
| 2,640,236 | A * | 6/1953 | Hume | 248/316.7 |
| 4,212,123 | A | 7/1980 | Robin | |
| 4,220,309 | A | 9/1980 | Eisen et al. | |
| 4,241,510 | A | 12/1980 | Radecki | |
| 4,336,884 | A | 6/1982 | Hart et al. | |
| 4,382,337 | A | 5/1983 | Bendick | |
| 4,455,756 | A | 6/1984 | Greene | |
| 4,473,957 | A | 10/1984 | Faulkner | |
| 4,512,084 | A | 4/1985 | Lieberman | |
| 4,517,860 | A | 5/1985 | Dameron, Jr. | |
| 4,549,713 | A | 10/1985 | Magadini | |
| 5,103,573 | A | 4/1992 | Ehling et al. | |
| 5,109,611 | A | 5/1992 | Houck | |
| 5,687,889 | A * | 11/1997 | Liden | 223/111 |
| 5,743,507 | A | 4/1998 | Rushing | |
| 5,802,729 | A | 9/1998 | O'Brien et al. | |
| 6,234,440 | B1 * | 5/2001 | Boney et al. | 248/354.1 |
| 6,449,863 | B1 | 9/2002 | Voorhees | |
| 6,618,955 | B2 | 9/2003 | Rice | |
| 6,663,075 | B2 | 12/2003 | Zuller | |
| 6,684,518 | B2 | 2/2004 | Voorhees | |
| 6,739,065 | B2 | 5/2004 | Hoffmeister | |
| 6,782,633 | B1 | 8/2004 | Cedrone | |
| 2001/0025393 | A1 * | 10/2001 | Nicolette | 15/105 |
| 2002/0066200 | A1 | 6/2002 | Lombardo | |
| 2002/0078582 | A1 | 6/2002 | Krake et al. | |
| 2002/0184780 | A1 | 12/2002 | Voorhees | |
| 2002/0189119 | A1 | 12/2002 | High | |
| 2003/0029986 | A1 | 2/2003 | Zuller | |
| 2003/0051363 | A1 | 3/2003 | Hoffmeister et al. | |
| 2003/0229999 | A1 | 12/2003 | Rimback | |
| 2004/0098875 | A1 | 5/2004 | Gould | |
| 2004/0177527 | A1 | 9/2004 | Prevost | |
| 2004/0216319 | A1 | 11/2004 | Muchnik | |
| 2004/0250458 | A1 | 12/2004 | Kim | |
| 2006/0096111 | A1 | 5/2006 | Dolenz et al. | |
| 2006/0196069 | A1 | 9/2006 | Groepper | |

* cited by examiner

*Primary Examiner*—Erin Smith
(74) *Attorney, Agent, or Firm*—Luedeka, Neely & Graham, P.C.

(57) ABSTRACT

A picture hanging apparatus aids in hanging pictures, paintings, or other similar wall mounted decorations. The apparatus temporarily supports the picture on a hanger such as a hook, which is suspended on a hanging arm attached to a wall end of a shaft leaning against a wall. The shaft, and thus by extension the hanger and the hanging picture, are moved freely until the desired position for the picture is found. Once found, the shaft remains in place against the wall while the picture is removed from the hanger. The position of the hook indicates where permanent picture hanging hardware such as a nail or permanent hook should be positioned in the wall in order for the picture to hang in the desired position.

21 Claims, 13 Drawing Sheets

PICTURE HANGING APPARATUS

CROSS REFERENCE TO RELATED APPLICATION

This patent application claims priority from and is related to U.S. Provisional Application Ser. No. 60/870,446 filed on Dec. 18, 2006, entitled: "Picture Hanging Apparatus".

FIELD

This invention relates to the field of accurately hanging items on walls. More particularly, this invention relates to an apparatus for accurately positioning an item such as a painting or a framed photograph on a wall for hanging.

BACKGROUND

The first step in hanging a picture semi-permanently against a wall is to determine the desired height and horizontal position of the picture. Typically, a person must hold the picture against a wall and have a second person standing at a distance from the wall in order to determine the desired height and horizontal position. For the first person to be able to view the picture against the wall in the proposed position, the second person must take the first person's place as picture holder, thereby allowing the first person to back away from the wall and view the position of the picture.

Such an exercise does not address potential difficulty in locating the proper position for a hanger for the picture. For example, one type of picture hanger includes a wire strung across the back of the picture longitudinally and attached to opposite sides such that it catches a hook or wall hanger when positioned properly against the wall. Simply determining the desired position of the picture against the wall does not provide the position to place the wall hanger in the wall such that the picture will hang at the desired position. The picture, when held against the wall, impedes the person from determining where the wall hanger should be positioned.

Aligning pictures is especially difficult in the context of collages or other conglomerate design arrangements involving multiple pictures and/or other decorations. In such arrangements, slightly improperly aligned pictures and/or other decorations stand out to the observer potentially to a greater extent than slightly improperly aligned pictures and/or other decorations occupying an otherwise empty wall. The slightest mistake in positioning the wall hanger or other hanging means results in a skewed overall impression of the arrangement.

Thus, a picture hanging apparatus configured for use by one person, without the necessity of a second person, is needed. The ideal picture hanging apparatus allows the user temporarily to position the picture in the desired location easily in both the vertical and horizontal directions such that the user may back away from the picture hanging apparatus and the picture hanging against the wall in order to determine whether the position of the picture needs adjustment. The picture hanging apparatus provides for easy repositioning if necessary until the desired position is achieved. Finally, the picture hanging apparatus allows the user to attach the wall hanger or other hanging means into the wall at a position such that the picture will hang in the desired position when hanging on the attached wall hanger.

SUMMARY

The above and other needs are met by a picture hanging apparatus for displaying a hanging picture at a wall hanging position corresponding to a picture hardware position and providing accurate placement of a picture hanging hardware at the picture hardware position when a user places the picture hanging apparatus in a picture hanging position. The picture hanging apparatus includes a shaft having a floor end and a wall end, the floor end for remaining stationary at a floor position on the floor and the wall end for remaining stationary at a wall position on the wall when the picture hanging apparatus is in the picture hanging position. A hanging arm has a shaft attachment end and a hanger end, the shaft attachment end configured to attach substantially at the wall end of the shaft when the picture hanging apparatus is in the picture hanging position. A picture hanger configured to attach substantially at the hanger end of the hanging arm and for temporarily hanging a picture when the picture hanging apparatus is in the picture hanging position.

In some embodiments, the hanging arm is selected from the group consisting of a string, a rope, and a chain and is substantially flat and is attached to the wall end of the shaft at a wall pivot point. In some, the hanging arm is disposed substantially flush against the wall when the picture hanging apparatus is in the picture hanging position.

In another embodiment, the picture hanging apparatus displays a hanging picture at a wall hanging position corresponding to a picture hardware position and provides accurate placement of a picture hanging hardware at the picture hardware position. It includes a shaft having a floor end and a wall end, the floor end for remaining stationary at a floor position on the floor and the wall end for remaining stationary at a wall position on the wall, a hanging chain comprising a plurality of links configured to removably attach substantially at the wall end of the shaft, the hanging chain having a hanger end and a shaft end, and a picture hanger configured to attach substantially at the hanger end of the hanging chain and for temporarily hanging a picture.

In some embodiments, the shaft is a telescoping shaft having a length, an outer portion and an inner portion for fitting inside the outer portion and extending from inside the outer portion to increase the length of the shaft. In some embodiments of the picture hanging apparatus, the shaft is hollow and has an outer surface and defines an interior, the shaft defines a chain aperture in the outer surface, and the hanging chain is disposed through the chain aperture of the shaft such that the shaft end of the hanging chain is disposed on the interior of the shaft.

In some embodiments, the wall end of the shaft is a rounded surface configured to contact the wall and remain stationary at the wall position, the rounded surface allowing the shaft to be leaned against the wall at a plurality of angles and remain stationary with respect to the wall.

In some embodiments, the wall end of the shaft includes a chain catch for catching one of the plurality of links allowing the hanger end of the hanging chain to hang a desired distance from the wall end of the shaft. In yet others, the hanger includes a substantially flat, substantially rectangular member defined a hammering aperture and having a hook, the hammering aperture for allowing the hanging picture to be removed from the hook and providing accurate placement of the picture hanging hardware at the picture hardware position. In yet others, the wall end of the shaft comprises a pad for protecting the wall and for maintaining the apparatus in a stationary position against the wall. The wall end of the shaft defines a trough through which the chain glides when a user repositions the chain in yet other embodiments.

A handle is attached proximate the shaft end of the hanging chain and configured for allowing a user to adjust a vertical component of the wall hanging position and a clamp attached proximate the shaft end of the hanging chain configured for removably attaching to the shaft such that once the user has adjusted the vertical component of the wall hanging position to the desired level, the clamp may be reattached to the shaft thereby maintaining the desired wall hanging position.

In another embodiment, the picture hanger comprises a double hook hanger having at least two hook hangers configured for temporarily hanging a picture in order to determine the wall hanging position.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
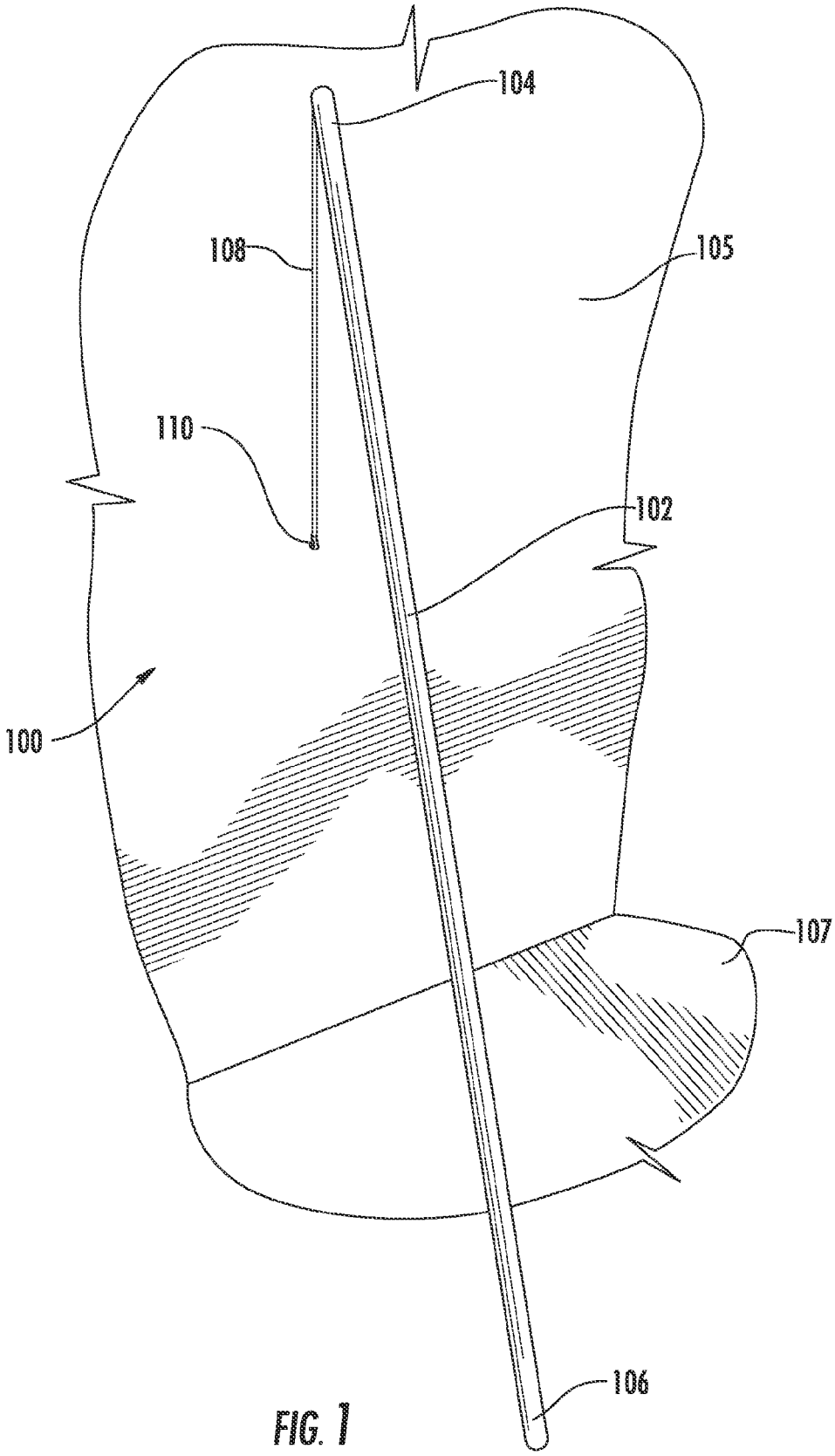
FIG. 1 is a perspective view of a picture hanging apparatus.

Referring to FIG. 1, one embodiment of the picture hanging apparatus 100 is shown. In this embodiment, the apparatus has a shaft 102, which in some embodiments is a rod or pole as shown in FIG. 1, which has a wall end 104 and a floor end 106 for contacting a wall 105 and a floor 107, respectively. The wall end 104 of the apparatus is attached to a hanging arm 108, which has a distal hanger end with an attached hanger 110. The hanger may be a hook, clasp, clamp or any other picture hanger or the like. The shaft 102 is leaned against a wall 105, and makes contact with the wall 105 at a location above which one would desire to hang a picture. When the picture is positioned in the desired picture hanging location, as used herein, the picture is in a "wall hanging position." The corresponding location on the wall where the picture hanging hardware, such as a hook or nail, should be placed in order to hang the picture at the wall hanging position is referred to herein as the "picture hardware position."

The hanger 110 is suspended on the hanging arm 108, which is attached to the shaft 102 at its wall end 104. The hanging arm 108, in this embodiment, may be a string, strap, chain or other flexible connector. In other embodiments, the hanging arm 108 may be connected via a pivot joint 410 as shown in FIGS. 4A-41 near the wall end 104 of the shaft 102. The shaft 102 leans against the wall 105 such that the hanger 110 hangs below the wall end 104 of the shaft 102 against or near the wall 105.

Figure 2A:
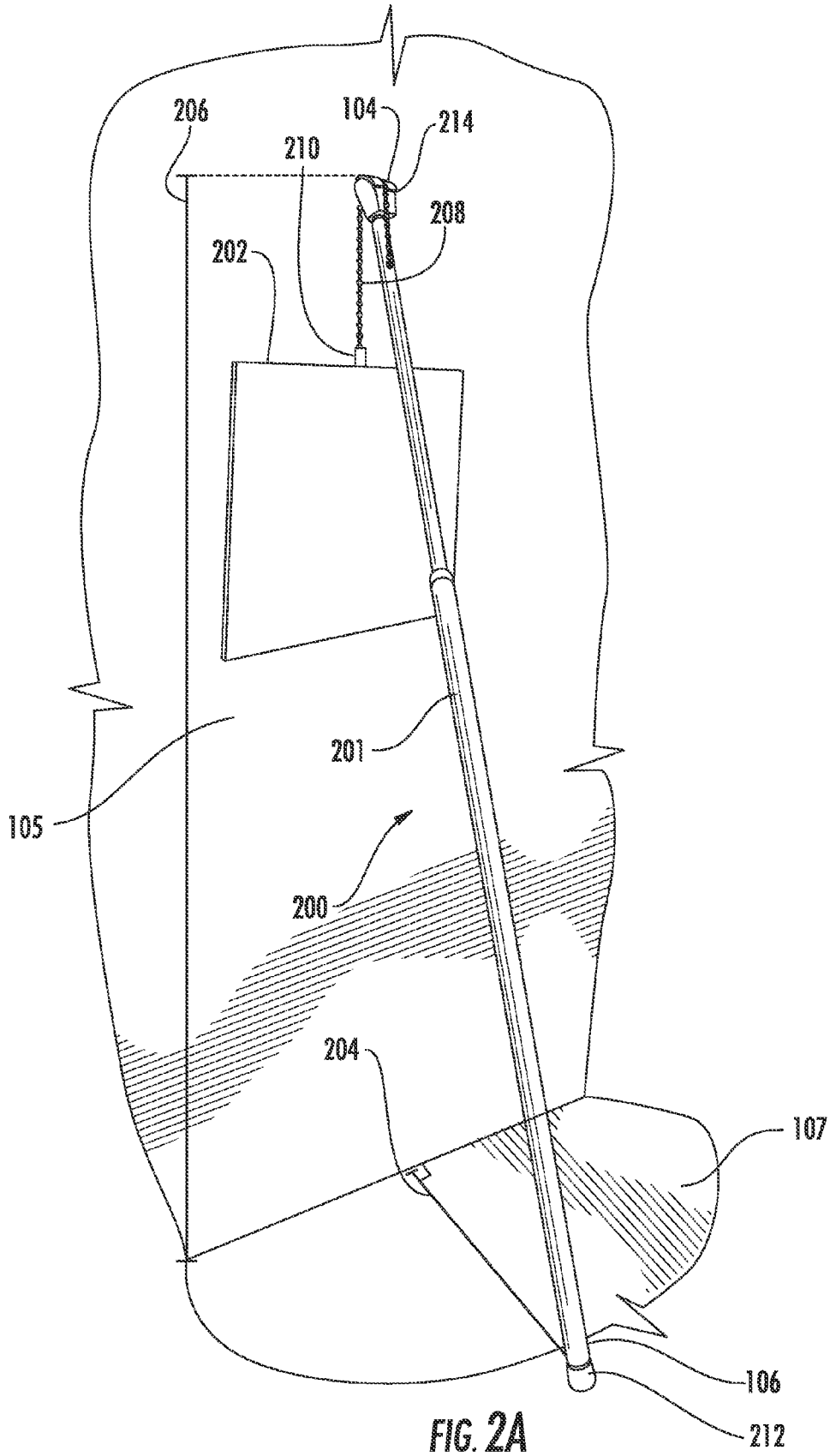
FIG. 2A is a perspective view of an alternate embodiment of the picture hanging apparatus being used to accurately position a painting.

Referring now to FIG. 2A, another embodiment of the picture hanging apparatus 200 is shown. A picture 202 is hung on a hanger 210 attached to the shaft 201 of the picture hanging apparatus 200 by hanging arm 208. The picture 202 may then be left in place temporarily without additional support, so that a user can observe the location of the picture 202 as it hangs against or near the wall 105. The user may consider the wall hanging position from a distance and may also measure the dimensions of the wall 105 and the picture 202 in order to accurately position the picture 202 at the desired wall hanging position. The user easily may reposition the picture hanging apparatus 200 and the picture 202 as necessary to achieve the desired wall hanging position. The picture hanging apparatus 200 may be repositioned by moving the shaft 201 to a different position on the floor 107 and/or the wall 105. Adjusting the shaft 201 in such a way adjusts the wall hanging position of the picture 202 by extension.

More specifically, the picture 202 is moved side to side (laterally or horizontally) by moving the shaft 201 side to side along the floor 107 and/or wall 105. The picture 202 is moved up and down (horizontally or vertically) by changing the angle of the shaft 201 relative to the wall 105. By shortening a distance 204 from the wall 105 to the floor end 212 of the shaft 201 (making the shaft 201 more upright), a height 206 at which the wall end 104 of the shaft 201 contacts the wall 105 increases, thus changing the height at which the picture 202 hangs. Once the desired wall hanging position for the picture 202 is determined, the user removes the picture 202 from the hanger 210, leaving the picture hanging apparatus 200, including the hanger 210 and the shaft 201 in place. The position of the now visible hanger 210, as illustrated in the close-up of the hanger 210 shown in FIG. 2B, indicates the picture hardware position corresponding to the picture wall hanging position. The picture hardware position is the position or location on the wall 105 where the user must attach picture hanging hardware in order for the picture 202 to hang at the desired wall hanging position when hanging from the picture hanging hardware. The user can install the picture hanging hardware with the hanger 210 in place, or mark the picture hardware position with a writing utensil such as a pencil, remove the hanger 208, and then install the permanent or semi-permanent picture hardware.

Figure 2B:
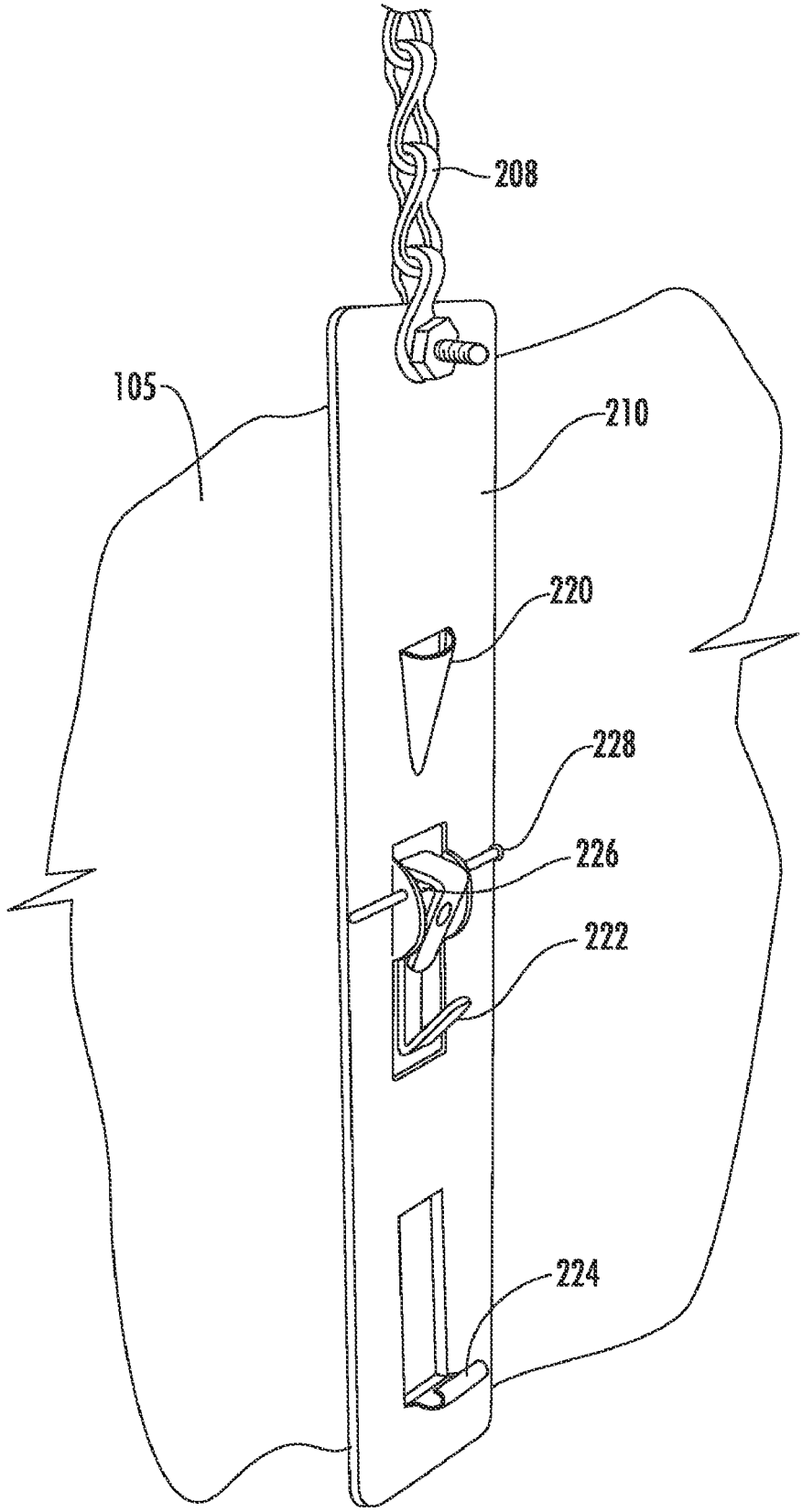
FIG. 2B is a close up view of a hanger of the embodiment of FIG. 2A.

As shown in FIG. 2B, this embodiment of the hanger 210 includes several different types of temporary hooks 220, 222, and 224. In some embodiments, the hanger 208 has only one type of temporary hook 220, 222, and 224 or may have any combination of two or more temporary hooks 220, 222, and 224. Additionally, temporary hook 222 may also function as permanent picture hardware. The user may hammer a nail through the appropriate aperture 226 in the temporary hook 222 and remove pin 228. Of course, the user should note which temporary hook 220, 222, or 224 on which he or she hangs the picture 202 before the positioning process begins as that particular temporary hook 220, 222, or 224 will ultimately indicate the accurate location of the picture hardware position.

A hanger 210 having multiple temporary hooks 220, 222 and 224 accommodates different types of picture hanging hardware as mounted to the back of the picture itself. For example, a wide flat hook, such as hook 224, works best for a picture that is suspended on a wire running across the back of the picture. A narrower, pointed hook, such as hook 220, works for pictures suspended on saw tooth type hangers. In these embodiments, the hooks 220, 222, and 224 may be made as separate units to be substituted for one another on the picture hanging apparatus 200, or may hang concurrently above and below one another on a hanger 210 as shown in FIG. 2B. In one embodiment, the temporary hooks 220, 222 and 224 are stamped into the face of a metal plate. This provides an open space above the hook for marking the wall 105 with the desired picture hardware position or mounting a permanent or semi-permanent hook.

In some embodiments, the picture hanging apparatus 200 has a hanger 210 with a hook that may function as temporary, permanent, or semi-permanent, such as 222 as discussed above. In this embodiment, hook 222 is temporarily held by the hanger 210 using the pin 228 or using a clamp. The picture hanging apparatus 200 functions in the same manner as described above, however once the picture is removed from the picture hanging apparatus 200, the user leaves the hook 222 against the wall and fastens it to the wall while it is supported by the hanger 210. The user then pulls the pin 228 or releases the clamp and removes the picture hanging apparatus 200, leaving the permanent hook 222 in the desired picture hardware position on the wall 105. In some embodiments, the temporary/permanent hook 222 is incorporated into a hanger having multiple hooks, such as the hanger 210 shown in FIG. 2B.

Referring back to FIG. 2A, in some embodiments, the shaft 201 has a non-slip foot 212 near the floor end 106 of the shaft 200. The non-slip foot 212 prevents the picture hanging apparatus 200 from sliding along the floor 107 when leaning against a wall 105. In some embodiments, the shaft 201 has a cap 214, which is rounded and/or padded in various embodiments, near the wall end 104 of the shaft 201. The cap 214 prevents the picture hanging apparatus 200 from marring or otherwise scarring the wall 105 as the picture hanging apparatus 200 leans against the wall 105. Additionally, the non-slip foot 212 and the cap 214 improve the stability of the picture hanging apparatus 200 when it is leaned against a wall 105.

In some embodiments, the shaft 201 is of variable length so that it can be extended to hang pictures 202 high on the wall 105 and be retracted for storage or for hanging pictures 202 lower on the wall 105. One type of variable length shaft 200 is a telescoping shaft as shown in FIG. 2A. The telescoping shaft 200 may be retracted to hang pictures above cabinets or furnishings such as a chest of drawers, such that the base of the shaft 200 rests on top of the cabinet or other furniture instead of being extended all the way to the floor 107. This variation in length of the shaft 200 may be accomplished by dividing the shaft 200 into separate sections which may be added or removed as necessary, by utilizing a folding pole, or by telescoping the shaft in two or more sections, referred to as an inner portion and an outer portion when two sections are used.

In some embodiments, the distance from the wall end 104 of the shaft 102 to the hanger 110 may be varied. In the embodiment of FIG. 1, the hanging arm 108, which is a string in FIG. 1, is attached, for example by tying, to the wall end 104 of the shaft 102 so that it can be loosened and adjusted to a new length. In some embodiments, a strap is used as the hanging arm 108 and is secured to the wall end 104 of the shaft 102 through a cam-type buckle, allowing the user to lengthen or shorten the strap by releasing the buckle. In some embodiments, such as those discussed with reference to FIGS. 2 and 3, a chain is used as the hanging arm 108 and is secured to the wall end 104 of the shaft 201 by a chain catch, which may be a pin or a hook.

Figure 3A:
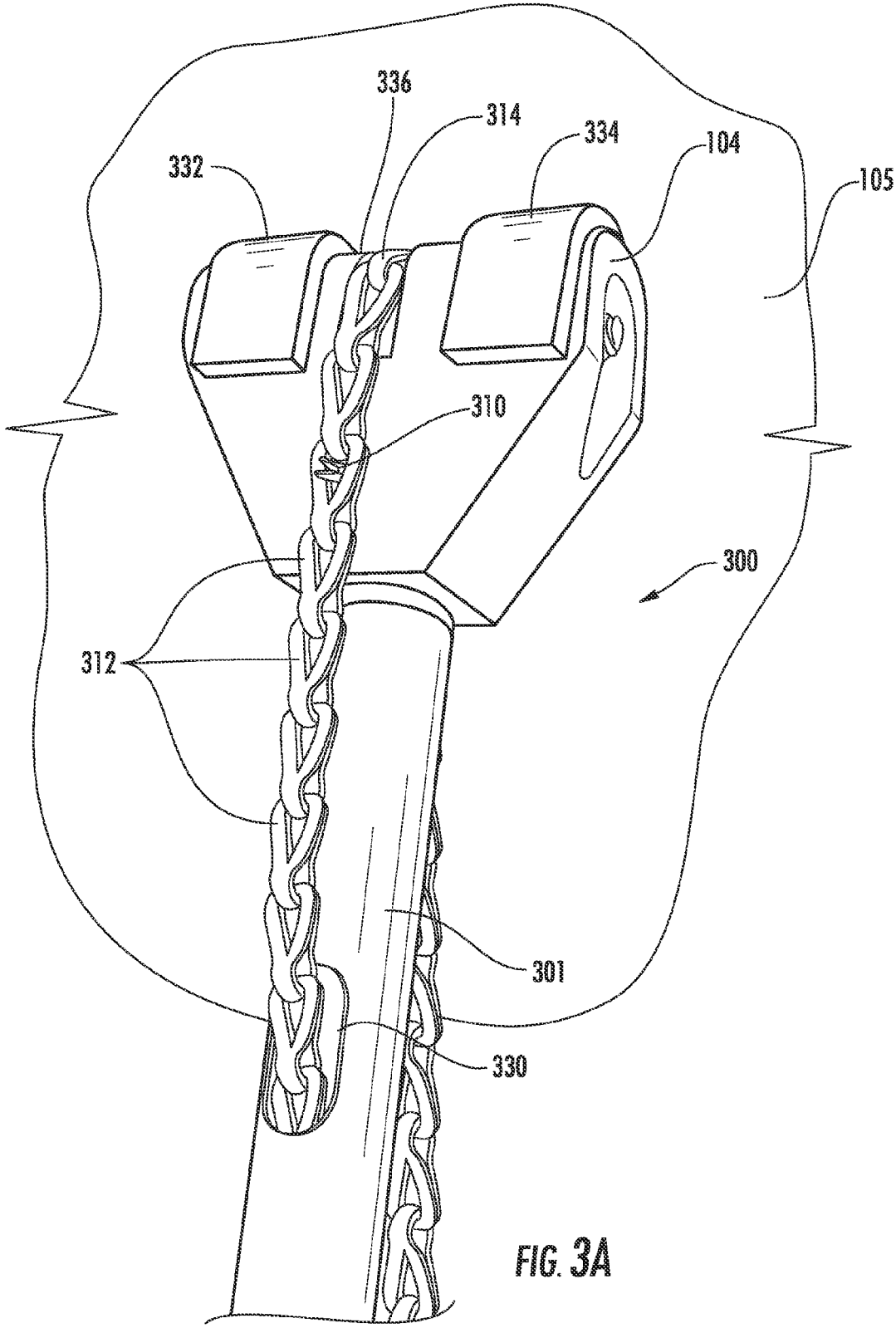
FIGS. 3A-3C are various views of another embodiment of the picture hanging apparatus having a chain.
Figure 3B:
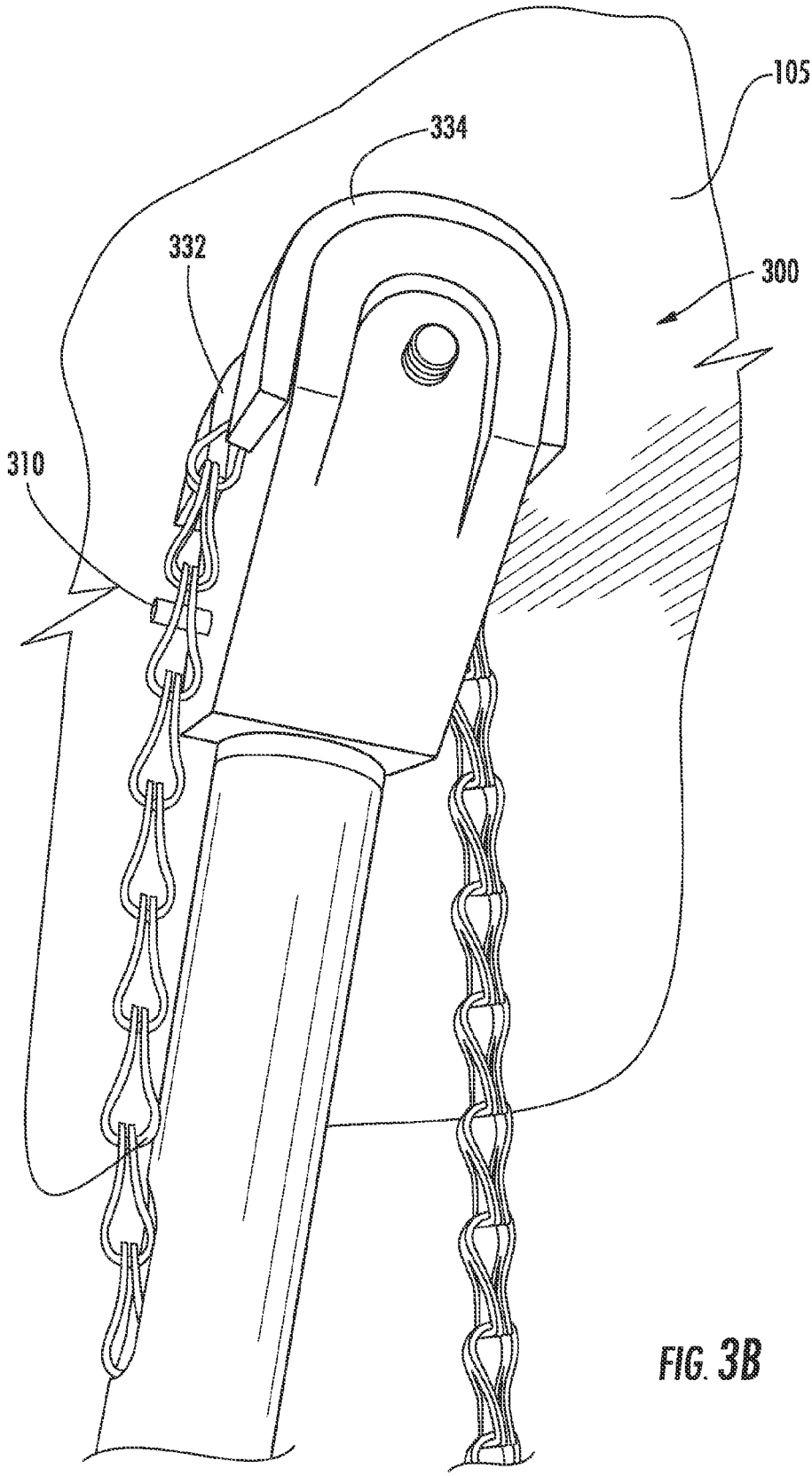
Figure 3C:
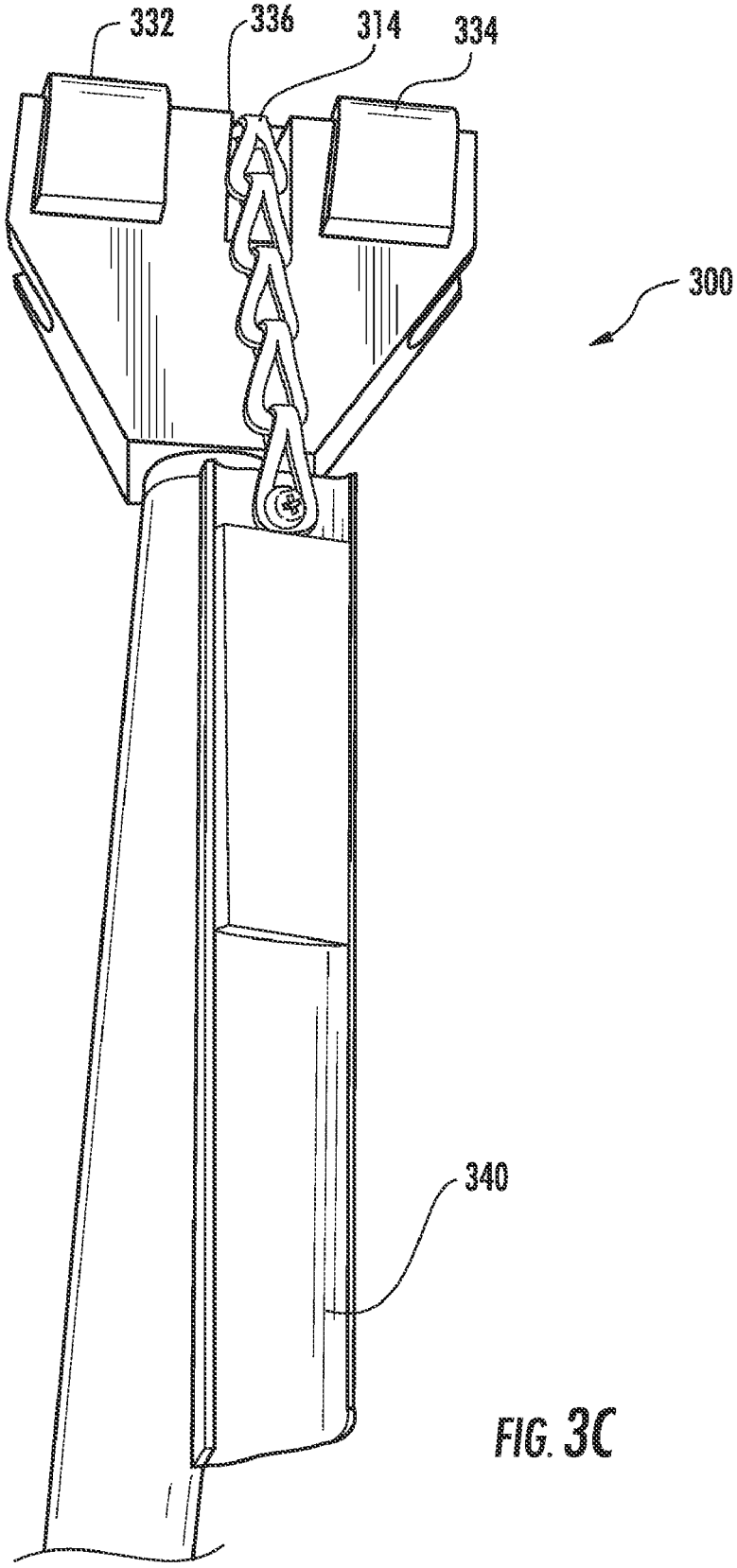

Referring now to FIGS. 3A-3C concurrently, another embodiment of the picture hanging apparatus 300 is shown. A chain catch 310 is configured for catching one of a plurality of chain links 312 which make up a chain 314. The chain catch 310 allows the chain to hang down from the wall end 104 of a shaft 301 at various lengths by engaging different chain links 312.

In some embodiments, the end of the hanging arm or chain opposite the hanger end is secured to the shaft 301 via a tie wrap or the like, or is run inside the hollow interior of the shaft 301 through an aperture 330 in the shaft 301. Rubber stops 332 and 334 are disposed at the wall end 104 of the shaft 301 and are configured for preventing the shaft 301 from sliding against the wall. A trough 336 is defined in the wall end 104 of the shaft 301 for allowing the chain 314 to glide between the wall end 104 of the shaft 301 and the wall.

Referring now to FIG. 3C, a back side 340 of a hanger 342 is shown. A rubber 344 is attached to the back side 340 of the hanger 342 in order to prevent the hanger from sliding against the wall absent a user's adjustment.

Figure 4A:
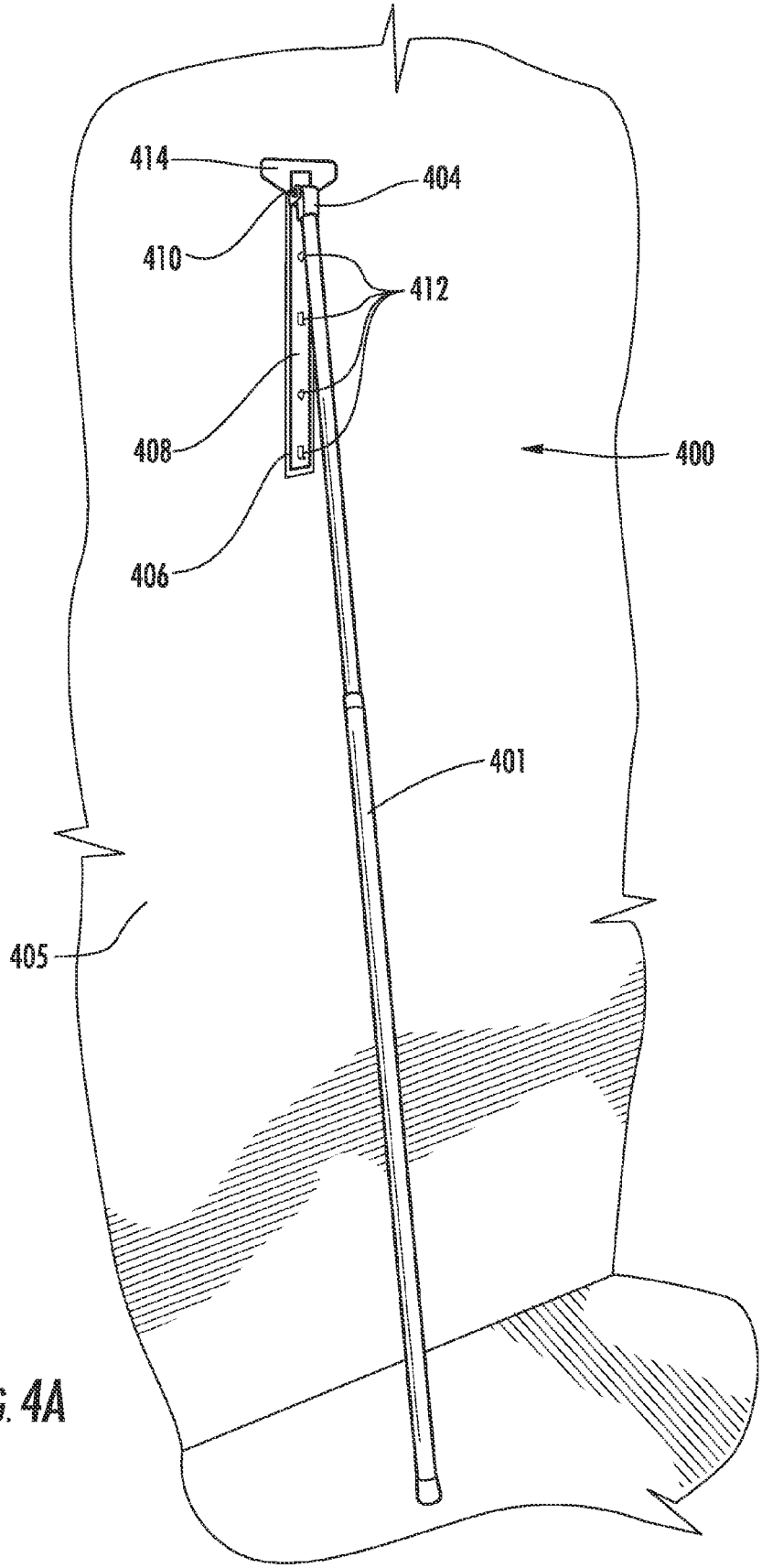
FIGS. 4A-4C are various perspective view of another embodiment of the picture hanging apparatus having a flush wall hanger.
Figure 4B:
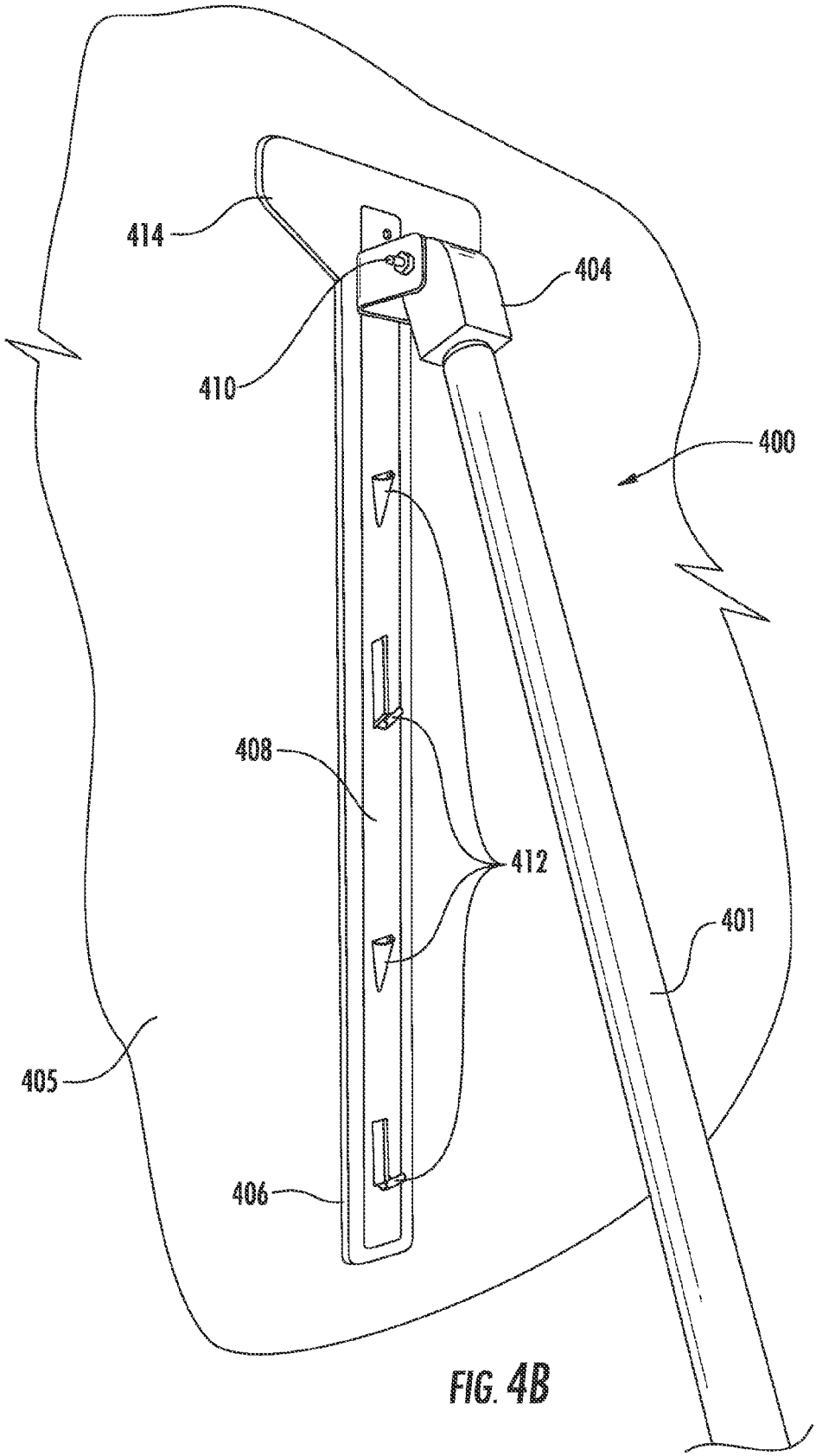
Figure 4C:
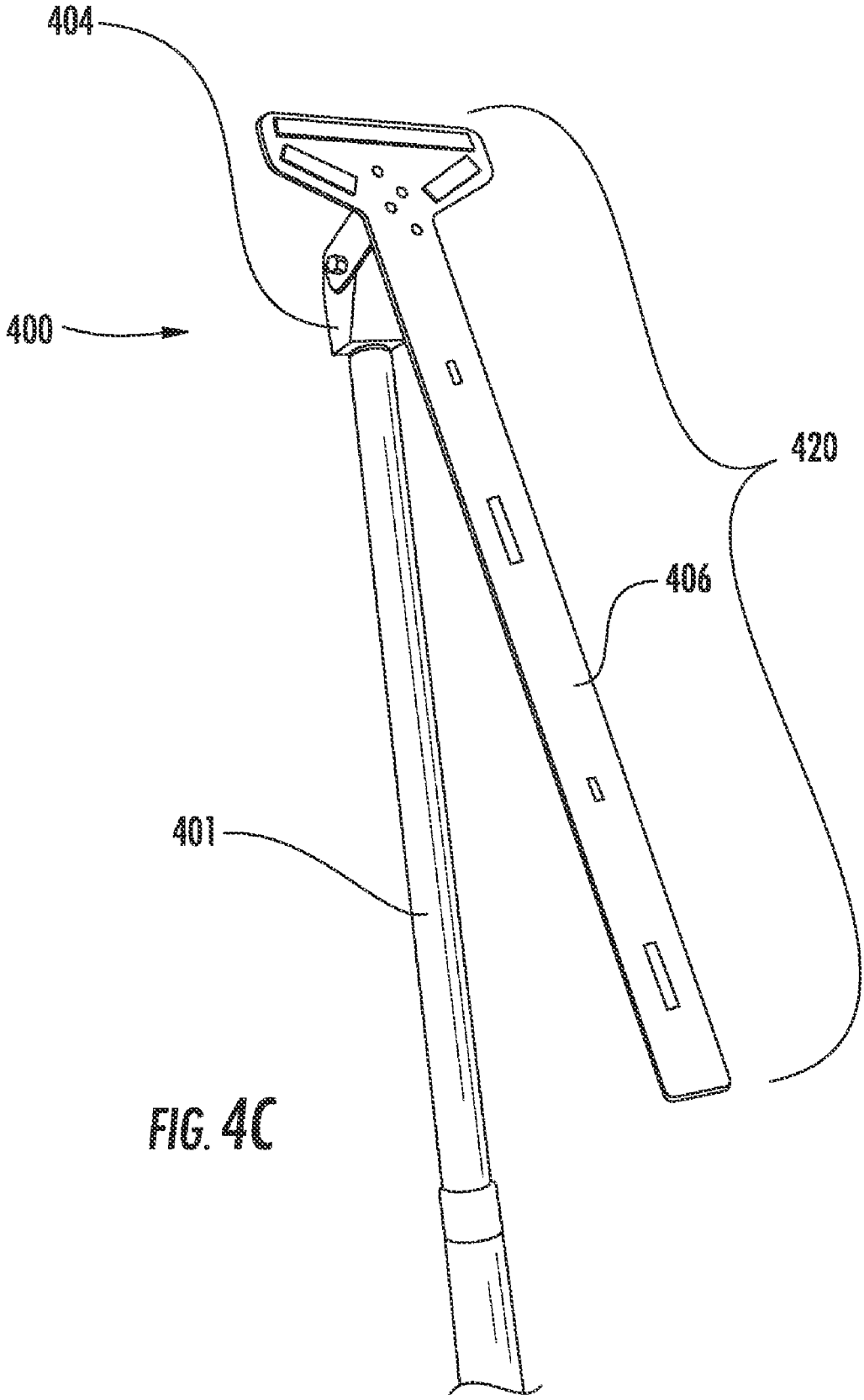

Referring to FIGS. 4A-4C concurrently, another embodiment of the picture hanging apparatus 400 is shown. This embodiment has a hanger 408 attached to an arm 406 that pivots at a pivot join 410 at the wall end 404 of the shaft 401. The arm 406, in some embodiments, is a piece of wood with a hanger 408 and a plurality of hooks 412 molded or stamped into the hanger 408 and/or arm 406 at various locations along the hanger 408 or arm's 406 vertical length. In some embodiments, the hooks 412 are made as separate units which are attached to the arm 406 along a track or the like so that the hooks may adjust their vertical position with respect to the arm 406. The arm 406, in some embodiments, has an upper arm portion 414, which extends above the pivot joint 410 at the wall end 404 of the shaft 400. The upper arm portion 414 assures that the arm 406 lay flat against the wall 405 when the picture hanging apparatus 401 is in use. In some embodiments, the arm 406 incorporates a bubble level to ensure that it is in a true vertical position when the picture hanging apparatus 401 is in use.

Figure 6A:
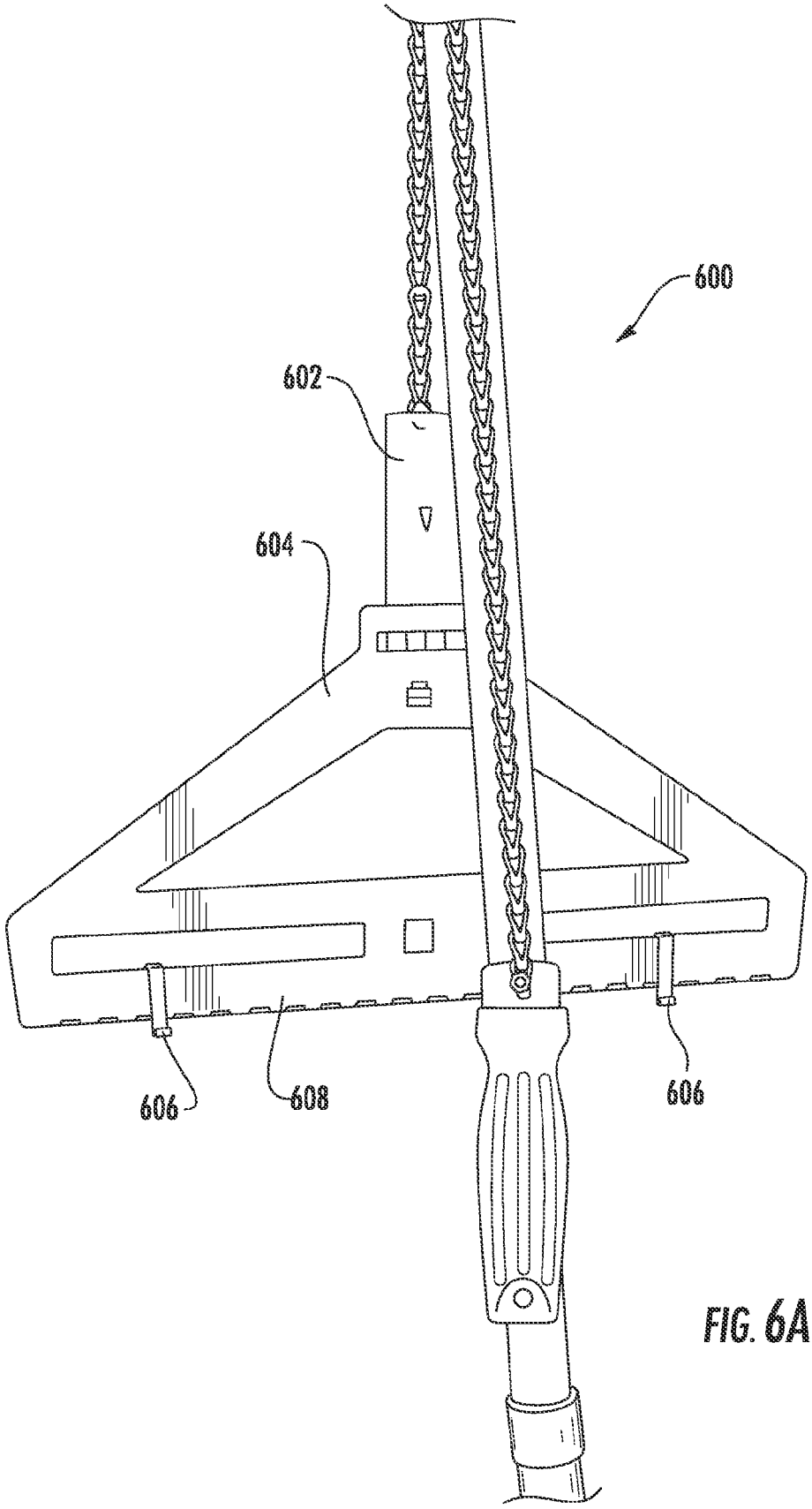
FIGS. 6A and 6B are perspective views of another embodiment of the picture hanging apparatus having a double hook hanger.
Figure 6B:
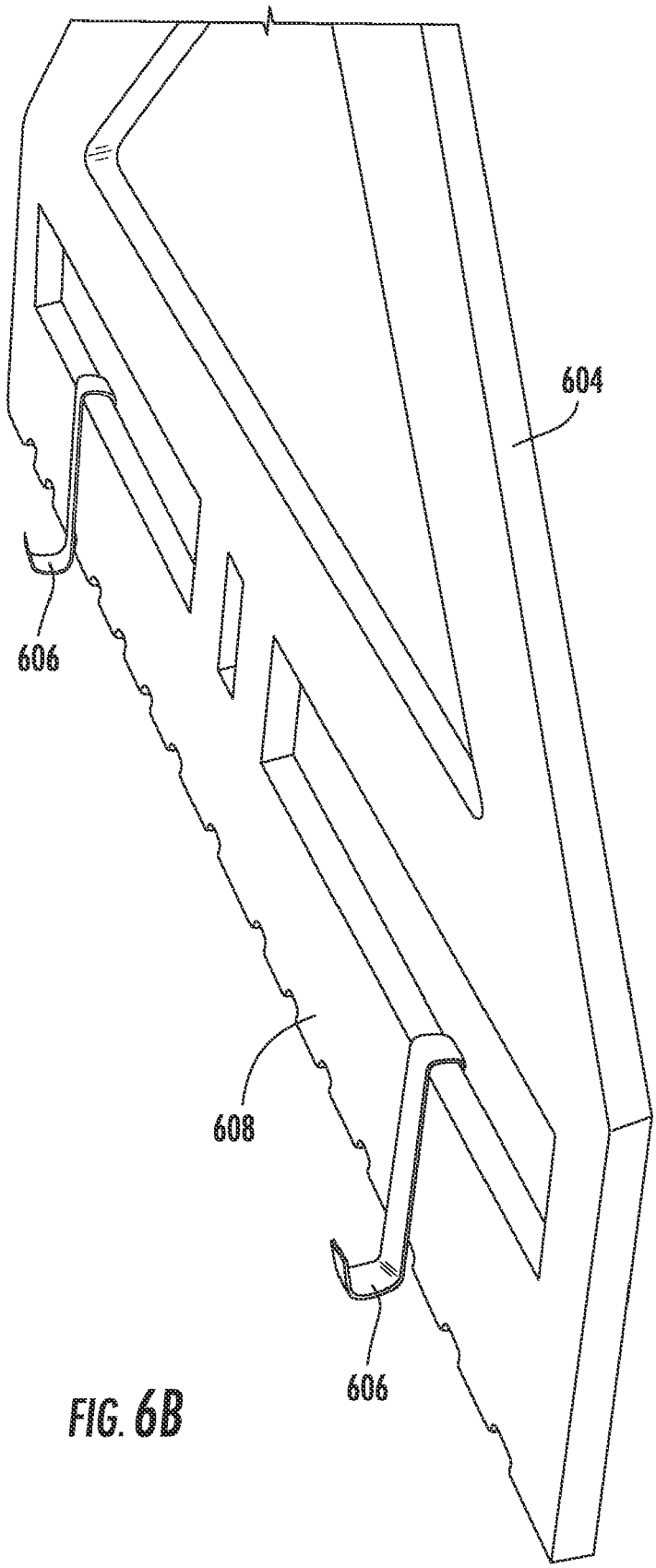

The arm 406, in some embodiments, is able to support a plurality of hooks 412, which are positioned side by side with appropriate spacing between them for the purpose of hanging a picture requiring two hooks. These hooks 412 may be of either fixed or adjustable position. A similar embodiment is shown in FIGS. 6A and 6B.

In some embodiments, the picture hanging apparatus 400 accommodates both a hanging arm, such as the string of FIG. 1 or the chain of FIGS. 2 and 3, and a rigid arm, such as the arm 406 of FIG. 4. A hanger 408 including a hook or hooks, or a hook or hooks without a hanger 408, is suspended from the hanging arm 108. Also, the stable arm 406 has a hook or hooks mounted to the arm 406 or a hanger 408 as described above. The arm 406, in some embodiments, is detachable via a removable pin at the pivot joint 410. The hanging arm 108 and its hanger and/or suspended hook(s) is also removable or retractable so that it does not interfere with the operation of the arm 406. This hybrid embodiment offers great flexibility in functionality of the picture hanging apparatus 100, 400 as various components may be interchanged as desired.

In one embodiment, the picture hanging portion 420, as shown in FIG. 4C, or just the hanging arm 108 or arm 406, is detachable from the shaft 102 or 401. The shaft 102 or 401 has a threaded wall end 404 similar to a broom handle in some embodiments. In such an embodiment, the picture hanging portion 420 screws onto the shaft 400 at the wall end 404 and provides the same functionality as the shaft 401 in the above discussion. Similarly, by detaching the picture hanging portion 420 from the shaft 401, the shaft 401 may then be used separately for any purpose that one might use the shaft 401. For example, if the shaft 401 is an extension-type shaft such as a telescoping shaft, it may be useful for attaching a broom or cleaning attachment for cleaning high windows.

Figure 5A:
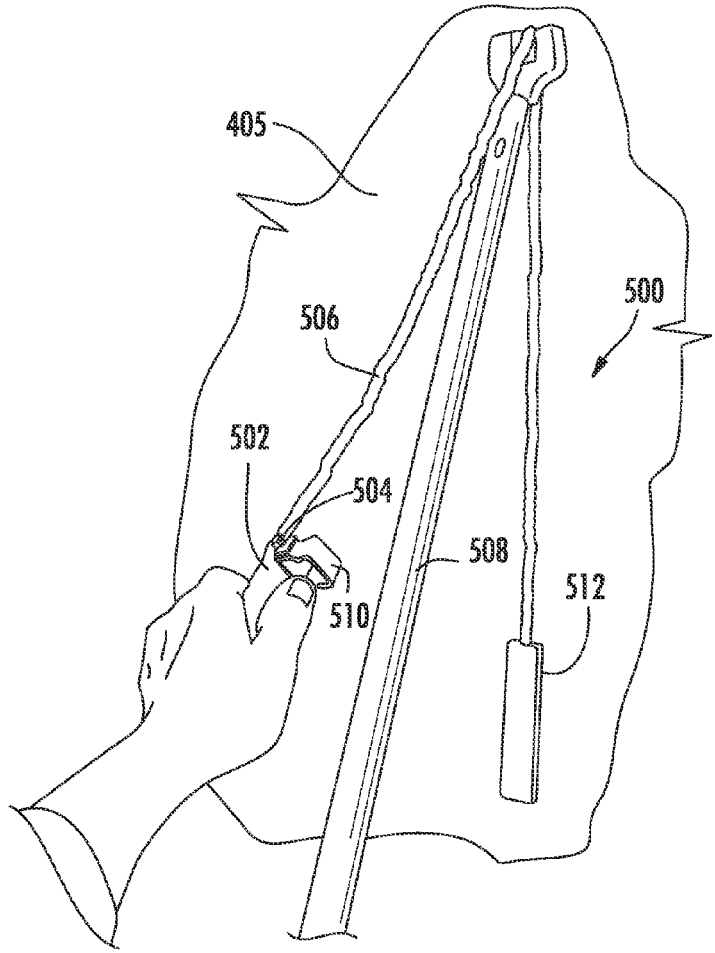
FIGS. 5A-5C are perspective views of another embodiment of the picture hanging apparatus having a handle and a clamp.
Figure 5B:
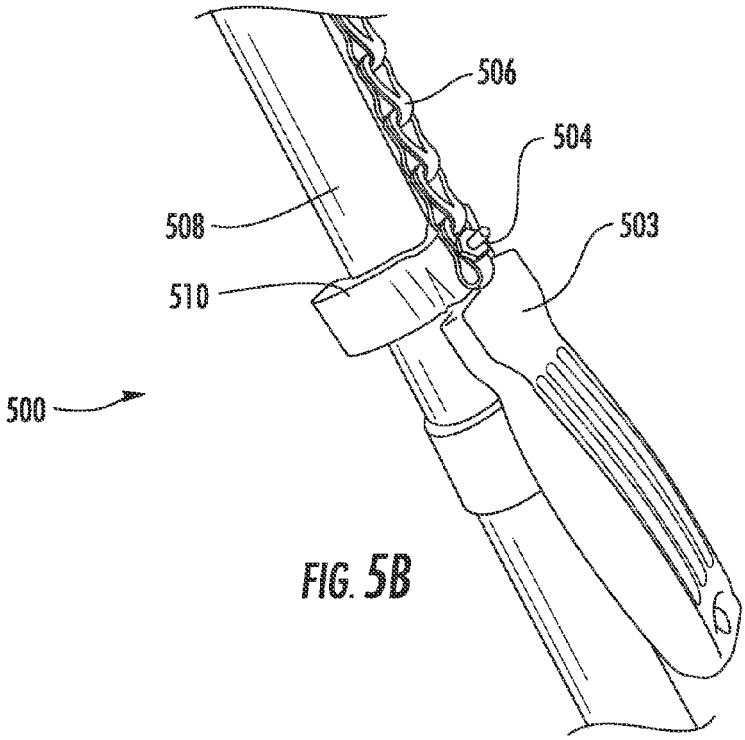

Referring now to FIGS. 5A and 5B concurrently, another embodiment of the picture hanging apparatus 500 is shown.

This embodiment has a handle 502 attached to the distal end 504 of the chain 506. The handle 502 is removably attached to the shaft 508 of the picture hanging apparatus 500 by clamp 510. The user, when desiring to raise or lower the hanger 512 at the opposite end of the chain 506 from the distal end 504, detaches the clamp 510 from the shaft 508 and moves the handle 502 until the hanger 512 is at the desired height. Once the desired height is achieved, the user reattaches the clamp 510 to the shaft 508 at a new location along the shaft 508. In some embodiments, the wall hanging position is maintained because the clamping force achieved by the clamp 510 when it is attached to the shaft 508 is sufficient to counteract the force pulling the chain 506.

Figure 5C:
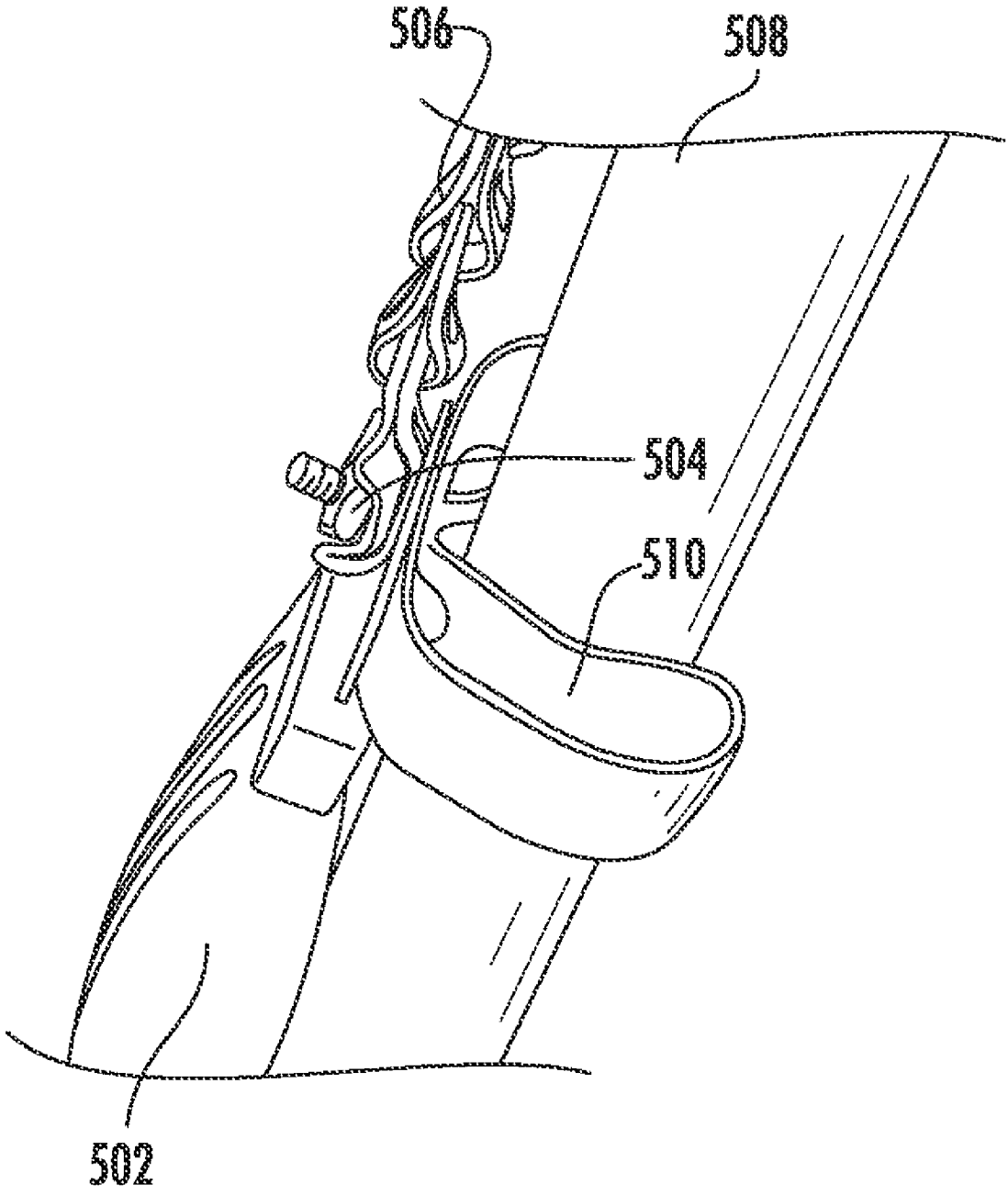

In other embodiments, the chain 506 is removably attached to a chain catch, similar to the chain catch 310 of FIG. 3 in order to maintain the desired wall hanging position. In these embodiments, the user detaches the clamp 510 from the shaft 508 and detaches the chain 506 from the chain catch (not shown), which is typically disposed proximate the wall end 104 (FIG. 3A) of the shaft 508, adjusts the picture to the desired wall hanging position, reattaches the chain 506 to the chain catch 310 and finally attaches the clamp 510 to the shaft 508. Various temporary attachment mechanisms are used in yet other embodiments in place of a clamp 510 as shown in FIG. 5.

Referring now to FIGS. 6A and 6B concurrently, another embodiment of the picture hanging apparatus 600 is shown. In this embodiment, the hanger 602 is attached to a removable double hook hanger 604. The double hook hanger 604 has two sliding hangers 606 configured to slide horizontally back and forth on the lower portion 608 of the double hook hanger 604. The double hook hanger is useful in application wherein the picture being hanged has a wire or string attached as its hanging mechanism.

The foregoing description of preferred embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A picture hanging apparatus for displaying a hanging picture at a wall hanging position corresponding to a picture hardware position and providing accurate placement of a picture hanging hardware at the picture hardware position when a user places the picture hanging apparatus in a picture hanging position, the picture hanging apparatus comprising:

a. a shaft having a floor end and a wall end, the floor end for remaining stationary at a floor position on the floor and the wall end for remaining stationary at a wall position on the wall when the picture hanging apparatus is in the picture hanging position;

b. a hanging arm having a shaft attachment end and a hanger end, the shaft attachment end configured to attach substantially at the wall end of the shaft when the picture hanging apparatus is in the picture hanging position; and c. a picture hanger configured to attach substantially at the hanger end of the hanging arm and for temporarily hanging a picture when the picture hanging apparatus is in the picture hanging position.

2. The picture hanging apparatus of claim 1 wherein the hanging arm is selected from the group consisting of a string, a rope, and a chain.

3. The picture hanging apparatus of claim 1 wherein the hanging arm is substantially flat and is attached to the wall end of the shaft at a wall pivot point.

4. The picture hanging apparatus of claim 1 wherein the hanging arm is disposed substantially flush against the wall when the picture hanging apparatus is in the picture hanging position.

5. A picture hanging apparatus for displaying a hanging picture at a wall hanging position corresponding to a picture hardware position and providing accurate placement of a picture hanging hardware at the picture hardware position comprising:

a. a shaft having a floor end and a wall end, the floor end for remaining stationary at a floor position on the floor and the wall end for remaining stationary at a wall position on the wall;

b. a hanging chain comprising a plurality of links configured to removably attach substantially at the wall end of the shaft, the hanging chain having a hanger end and a shaft end; and c. a picture hanger configured to attach substantially at the hanger end of the hanging chain and for temporarily hanging a picture.

6. The picture hanging apparatus of claim 5 wherein the shaft is configured to vary in length as desired by a user.

7. The picture hanging apparatus of claim 5 wherein the shaft is a telescoping shaft having a length, the shaft comprising an outer portion and an inner portion for fitting inside the outer portion and extending from inside the outer portion to increase the length of the shaft.

8. The picture hanging apparatus of claim 5 wherein:

a. the shaft is hollow and has an outer surface and defines an interior;

b. the shaft defines a chain aperture in the outer surface; and c. the hanging chain is disposed through the chain aperture of the shaft such that the shaft end of the hanging chain is disposed on the interior of the shaft.

9. The picture hanging apparatus of claim 5 wherein the wall end of the shaft comprises a rounded surface configured to contact the wall and remain stationary at the wall position, the rounded surface allowing the shaft to be leaned against the wall at a plurality of angles and remain stationary with respect to the wall.

10. The picture hanging apparatus of claim 5 further comprising a chain catch disposed proximate to the wall end of the shaft and for catching one of the plurality of links allowing the hanger end of the hanging chain to hang a desired distance from the wall end of the shaft.

11. The picture hanging apparatus of claim 5 wherein the hanger comprises a hook for temporarily hanging the picture.

12. The picture hanging apparatus of claim 5 wherein the hanger comprises a substantially flat, substantially rectangular member defined a hammering aperture and having a hook, the hammering aperture for allowing the hanging picture to be removed from the hook and providing accurate placement of the picture hanging hardware at the picture hardware position.

13. The picture hanging apparatus of claim 5 wherein the wall end of the shaft comprises a pad for protecting the wall and for maintaining the apparatus in a stationary position against the wall.

14. The picture hanging apparatus of claim 5 wherein the rounded surface of the wall end of the shaft defines a trough through which the chain glides when a user repositions the chain.

15. The picture hanging apparatus of claim 5 further comprising a handle attached proximate the shaft end of the hanging chain configured for allowing a user to adjust a vertical component of the wall hanging position.

16. The picture hanging apparatus of claim 15 further comprising a clamp attached proximate the shaft end of the hanging chain configured for removably attaching to the shaft such that once the user has adjusted the picture thereby achieving the desired wall hanging position, the clamp may be reattached to the shaft thereby maintaining the desired wall hanging position.

17. The picture hanging apparatus of claim 15 further comprising a chain catch disposed proximate to the wall end of the shaft and for catching one of the plurality of links such that once the user has adjusted the picture thereby achieving the desired wall hanging position, the chain may be removably attached to the chain catch thereby maintaining the desired wall hanging position.

18. The picture hanging apparatus of claim 1 wherein the picture hanger comprises a double hook hanger having at least two hook hangers configured for temporarily hanging a picture in order to determine the wall hanging position.

19. The picture hanging apparatus of claim 1 wherein the picture hanger comprises a first hanger removably attached to a double hook hanger having at least two hook hangers configured for temporarily hanging a picture in order to determine the wall hanging position.

20. The picture hanger apparatus of claim 5 further comprising:

(a) a handle attached proximate the shaft end of the hanging chain configured for allowing a user to adjust a vertical component of the wall hanging position and (b) a clamp attached proximate the shaft end of the hanging chain configured for removably attaching to the shaft such that once the user has adjusted the vertical component of the wall hanging position to the desired level, the clamp may be reattached to the shaft thereby maintaining the desired wall hanging position; and wherein the picture hanger comprises a double hook hanger having at least two hook hangers configured for temporarily hanging a picture in order to determine the wall hanging position.

21. The picture hanging apparatus of claim 18 wherein the double hook hanger includes an elongate lower portion and the at least two hook hangers are configured to slide substantially horizontally along the lower portion.

* * * * *